United States Patent [19]

Kelly et al.

[11] 4,117,797

[45] Oct. 3, 1978

[54] MAST AND KEEL MOVEMENT FOR SAILING VESSELS

[76] Inventors: Hartleigh Kelly, 3 Weewanda St., Glenelg South, Australia, 5045; Bruce A. Kelly, 54 Kauri Parade, Seacliff, Australia, 5049; Ross A. Kelly, 2A Clearview St., Beaumont, Australia, 5066

[21] Appl. No.: 778,090

[22] Filed: Mar. 16, 1977

[30] Foreign Application Priority Data

Apr. 1, 1976 [AU] Australia ..... PC5451

[51] Int. Cl.[2] ..... B63B 15/00

[52] U.S. Cl. ..... 114/91; 114/143

[58] Field of Search ..... 114/143, 130–137, 114/91

[56] References Cited

U.S. PATENT DOCUMENTS

| | | | |
|---|---|---|---|
| 704,685 | 7/1902 | Jensen | 114/143 |
| 3,903,827 | 9/1975 | Marcil | 114/143 |
| 3,972,300 | 8/1976 | Adamski | 114/143 X |

*Primary Examiner*—Trygve M. Blix
*Assistant Examiner*—Sherman D. Basinger
*Attorney, Agent, or Firm*—J. Harold Nissen

[57] ABSTRACT

A sailing vessel having a mast upstanding from the hull and connected to be free to tilt on the hull about a longitudinal axis, and a keel depending from the hull and also connected to be free to tilt on the hull about a longitudinal axis, the mast and keel being interconnected to cause rotation about the axes in the same sense, the keel having sufficient weight to hold the mast upright but allowing it to deflect leeward about the hull under wind pressure, the keel balancing the leeward deflection by tilt to windward without necessarily deflecting the hull.

3 Claims, 7 Drawing Figures

MAST AND KEEL MOVEMENT FOR SAILING VESSELS

This invention relates to improvements in and to sailing vessels.

In sailing vessels it is usual to secure to the boat hull a mast by means of which the sail is carried and to have on the hull a fixed ballasted keel or a ballasted centre board for the purpose of balance and control.

With vessels as constructed heretofore, as the wind operates on the sail, so the mast and the vessel lean and consequently the keel leans at the same angle, all of these units forming part of a rigid construction.

The efficiency of movement of a vessel is affected by any deviation of the vessel from its normally designed balance in the water and if, for instance, the mast heels over to the left, the left side of the vessel is forced into the water and the right side tends to lift and, while this is to some extent balanced by the keel, there nevertheless must be a movement of the boat hull because the mast is fixed and guyed thereto and therefore, as the angle of the boat increases due to wind pressure on the sail, unless specially designed for heeled sailing, the hull usually presents a greater drag with the result that there is a loss of speed.

The object of the present invention is to overcome at least by a required degree, the effect of the tilting of the boat hull about its longitudinal axis, and this has been achieved according to our invention by pivoting the mast on a longitudinal axis in relation to the hull and to also pivot the keel on a longitudinal axis, so that the mast is balanced by the keel and not necessarily by the hull of the boat.

Thus, according to our invention, if the mast is deflected leeward, the keel is deflected windward by a regulated amount and the effect of this, as both are free to tilt on the boat hull in relation to their longitudinal axis, is to cause the mast and the keel to lean in relation to the hull and to leave the hull somewhat in its normal position as supported by the water.

The method of connecting the mast and the keel can of course be varied and direct mechanical connections or hydraulic mechanisms could be used. Electric or servo mechanisms could also achieve the object as it is only necessary to angle the keel to conform to the angle of the mast and it will be realised that quite simple mechanical connections or chain connections can be used where simplicity is required, the required ratio between tilt of the mast and movement of the keel being readily attainable by appropriately adjusting the leverage system or in the case of a chain, the sprocket sizes.

The tilt of the keel can be achieved by using the guy wires for the mast as these may be passed through suitable channels and attached to the keel, such variations however being readily effected by persons versed in the art.

Thus, according to the present invention, the mast is pivoted to provide a source of energy for automatically providing and controlling the heel of the keel, this adjustment resulting in a desired listing without necessarily changing the angle of the hull itself so that the boat in a more upright position for comfort, safety and possibly speed.

It will be realised that a boat which is more nearly upright is much easier and safer to work upon than one on which one is steeply inclined and that the tilting of the keel to windward reduces the lateral resistance and thus reduces the tendency to capsize.

Obviously because the ratio of movement of the mast to the keel can be varied, the design can be such as to give more or less heel to the boat with a given mast heel, and the heel of the mast can also be used to operate vanes or the like to assist the stabilizing of the boat in a particular relationship to the angle of the mast, as in some cases it may be desirable to control the angle of the boat hull to perhaps partly follow the heel of the mast, but again such variations will be within the skill of the persons versed in this art, provided it is recognised that by appropriate location of the mast and the keel and appropriate interconnection, it is possible to also control the heel of the boat hull to achieve maximum results.

It would be advantageous to use a hydraulic system as this can automatically heel the keel to match the heel of the mast and also hand or motor actuated hydraulic pumping can be used to adjust the heel of the keel as desired. Further, automatic neutralizing of the system could be provided if in an emergency it was required to do this, or by appropriately locking the system a fixed keel will result as in existing designs.

Also a hydraulic system could be provided with accumulators to eliminate shock in the system, or for storage of control energy.

So far as efficiency is concerned, it is possible that reduced ballast weight of the keel can be used with a moveable keel as the movement can give increased stability but also it may be desirable to reduce beam measurements of the vessel because of the better balance which is achieved according to our invention.

It has been found in tests that the folding up of the keel can reduce lateral resistance, giving a safer boat in strong winds, but with more leeway. Keels could be deep or shallow with the weight spread or concentrated at the bottom to give required stability, or the keel shape could be designed to give a choice of the degree of lateral resistance.

The invention can be carried into effect in various ways but to enable the nature of it to be fully appreciated some embodiments will now be described with reference to the accompanying drawings which are of an illustrative nature only and not to be taken as necessarily limiting the invention.

Figure 1:
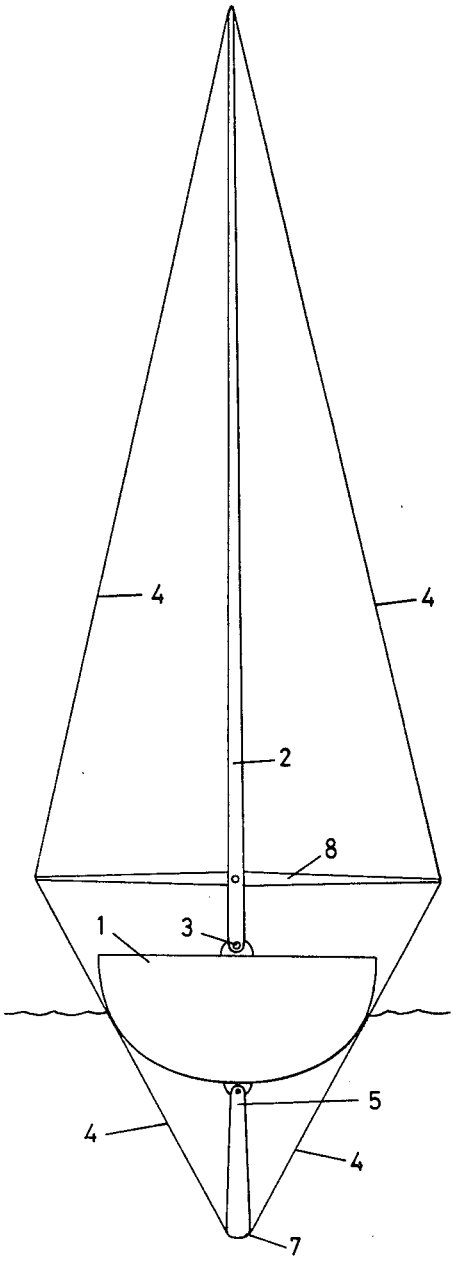
FIG. 1 is a schematic end elevation of a sailing vessel according to this invention showing the mast and the keel both pivoted to the hull and interconnected by means of shrouds which pass on each side of the hull to cause the keel to tilt oppositely to the mast.
Figure 2:
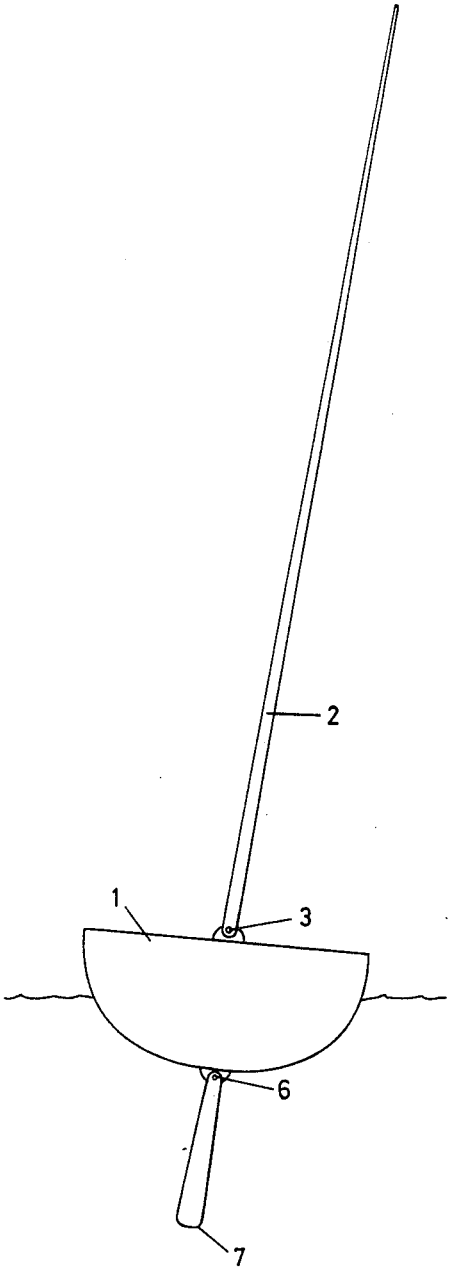
FIG. 2 is a schematic view showing how a vessel in a medium wind can have its hull in a medial position with the deck substantially horizontal but with the mast and the keel angled thereto, the keel balancing the tilt of the mast to ensure that the hull can remain in a position where the deck is substantially horizontal.
Figure 3:
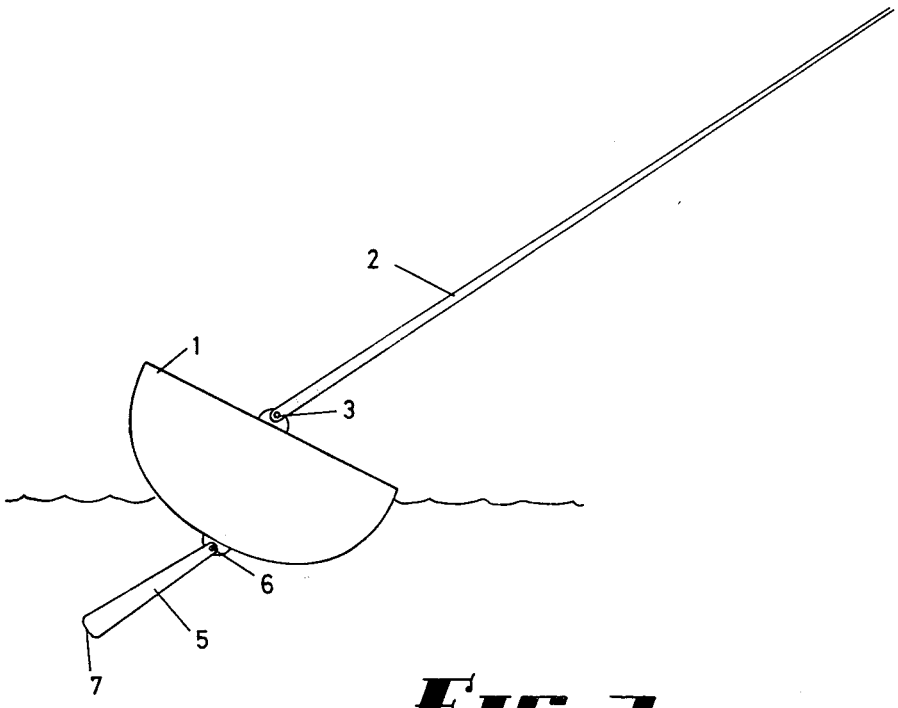
FIG. 3 is a similar view but showing the position with a stronger wind to indicate how the hull can still be held at a lesser inclined angle than with existing attachments.

Referring first to FIGS. 1, 2 and 3 which can have the same mechanism for tilting the keel under control of the mast, the hull 1 carries on it a mast 2, which is connected to the hull by a pivot 3, and has the usual shrouds 4 whereby the mast is held.

The keel 5, is in turn connected to the hull by a pivot 6, so that both the mast and the hull can move about these pivots which are longitudinally arranged on the hull 1.

To move the keel 5 the shrouds 4, are carried down and attached to the base 7 of the keel, being held to pass on the outside of the hull by a spreader 8 which is attached to the mast 2.

In FIG. 2 is shown the position when there is a moderate wind, the mast 2 having been moved over, and this motion being transmitted by the shroud to the keel 5, so that the hull remains upright or relatively upright.

In FIG. 3 as shown, a more extreme position in strong winds with the mast at a substantial angle and the keel similarly angled, but it will be realised that by appropriate connection, the position of the hull could be controlled to be in a flatter or more horizontal position than shown.

Figure 4:
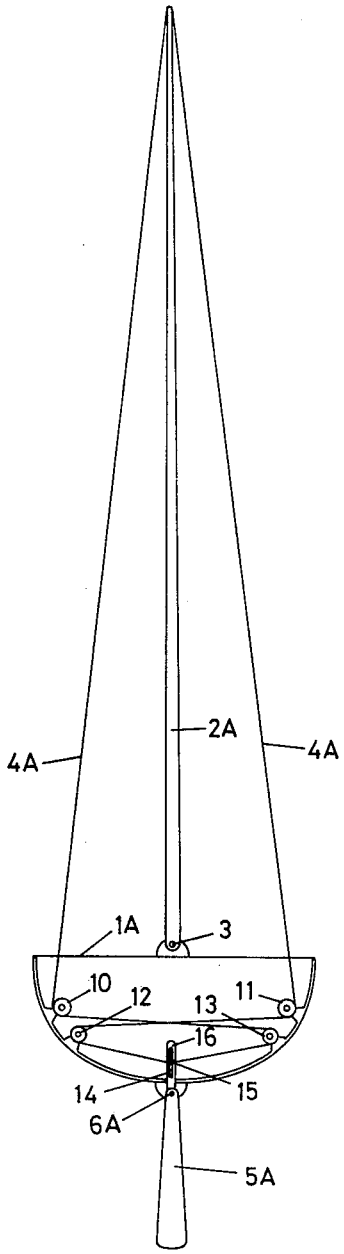
FIG. 4 is a view corresponding to FIG. 1 but showing how the cables from the keel may be located internally of the vessel to position the mast, the ratio of movement of the keel to the mast being selectable by moving the attachment point on the keel toward or away from the keel pivot.

FIG. 4 merely shows another form of arrangement in which the mast 2*a* is connected to the keel 5*a* by having the shrouds 4*a*, passing around pulleys 10 and 11 and pulleys 12 and 13 which have their axles fixed to suitable supports in the hull, and the ends of the shrouds 4*a* are attached to a lever 14 which extends upwardly from the keel, the attachment point 15, being moveable on the lever 14 in a slot 16 to allow the ratio of movement to be varied.

Figure 5:
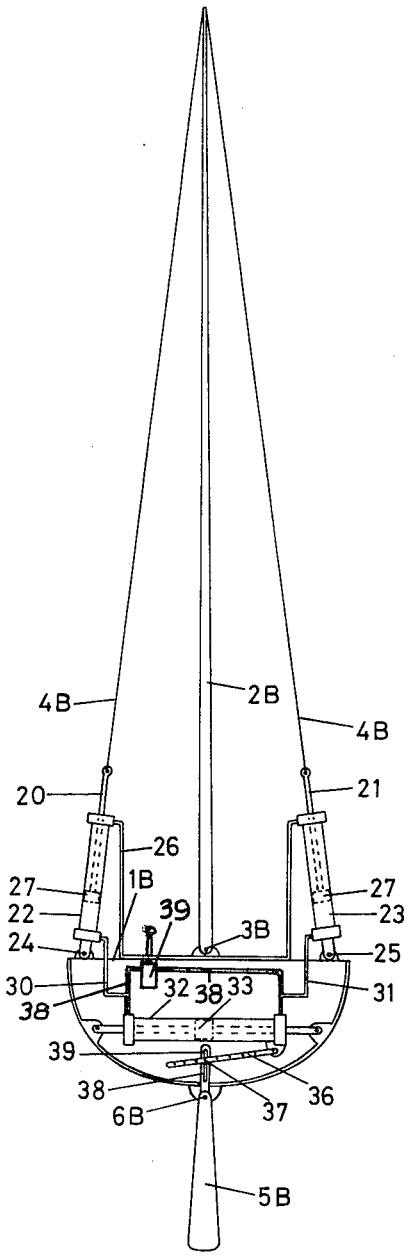
FIG. 5 shows a preferred form of device in which hydraulic actuation is used, the hydraulic actuating cylinders in this case having their pistons attached to the shrouds and being in turn interconnected for opposite movement and also connecting to a slave cylinder with a fixed piston in which the cylinder moves to tilt the keel as the mast is deflected.

In the embodiment shown in FIG. 5, the mast 2*b* and the keel 5*b*, are similarly pivoted to the hull 1*b*, but the shrouds 4*b* are attached to the piston rods 20 and 21 of hydraulic actuators comprising a pair of cylinders 22 and 23, which are connected to the hull 1*b*, by pivots 24 and 25 so that they can lean during shroud movement, the hydraulic actuators so formed having their upper fluid space connected together by a hydraulic line 26, so that displacement of hydraulic fluid from above the pistons 27 and 28, from one to the other, maintains correct action, the space beneath the pistons 27 and 28 being connected by lines 30 and 31, to the two ends of a hydraulic actuator in the form of a cylinder 32, the piston 33 of which is fixed on a rod connected at 34 and 35 to the hull.

In this way, as there is a fluid displacement in the hydraulic actuators 22 and 23, the cylinder 32 moves from side to side, and this actuator cylinder is coupled by means of a connecting rod 36 to a pivot pin 37, slideable in a slot 38 on a lever 39, which extends upwardly and forms part of the keel 5B.

In this way as the mast leans, the hydraulic actuator cylinder 32 is caused to move laterally, and through the cylinder 22 appropriately move the keel 5B, and because of the use of a movable pivot pin 37, the ratio of movement can be closely controlled. A by-pass is indicated by the lines 38 which connect to a valve or hand pump 39 so that the keel 5B can be angularly moved in relation to the mast.

Figure 6:
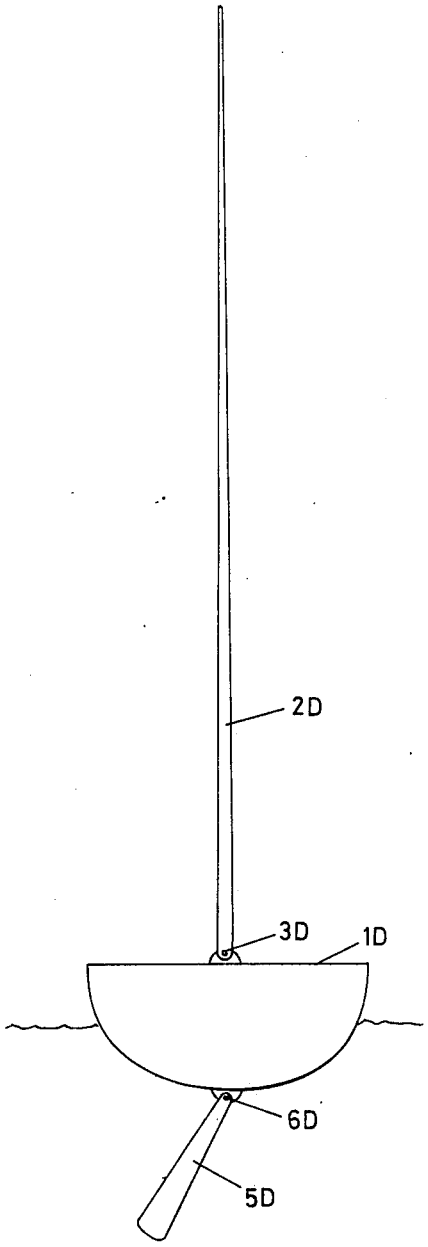
FIG. 6 shows how by moving the keel to an asymmetrical position the wind against the sail can be countered and the mast maintained substantially upright with the hull also in a normal position.

In FIG. 6 is shown how the hull 1D has the mast 2D relatively upright on it, and the keel 5D, has been angled to balance wind pressure against the sails, this Figure merely indicating that it is possible by appropriate positioning of the keel to hold the hull, and if necessary the mast, in a relatively upright position.

Figure 7:
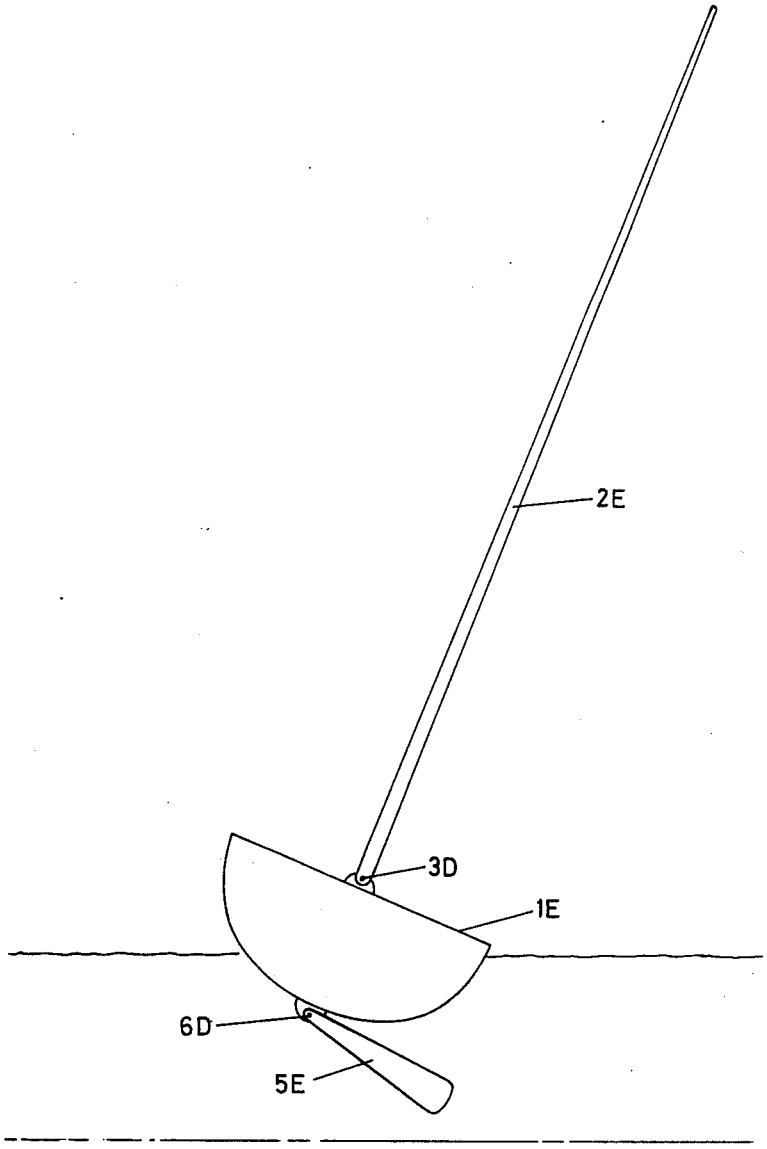
FIG. 7 is a further schematic view showing how, when it is necessary to cross a sand bar, the keel can be moved to an extreme position to thereby reduce the draft of the vessel.

FIG. 7 merely indicates that in any device where the ratio of movement or the position of movement of the keel 5E in relation to the hull 1E is variable such a position shows how this movement can be used to cross a sand bank by reducing the draft of the vessel.

To enable independent manipulation of the keel the hydraulic system shown in FIG. 5 can be used, the pumps or valve 39 permitting displacement of some hydraulic fluid from one side to the other in the cylinder 32, thus moving the cylinder and through the link 36 to the position of the keel.

From the foregoing it will be realised that according to this invention instead of the mast and the keel being in a fixed relationship to the hull of the boat, both may be made moveable and the mast and the keel are so designed that the wind pressure on the sails can be balanced by displacement of the keel without the hull of the vessel itself necessarily having to be heeled to the same extent, but, according to the design, such as by special shaping of the keel and a concentration of the weight at an appropriate part of the keel, the movement can be arranged to give some amount of heeling of the boat about a longitudinal axis which can be positive or negative according to requirements, because it will be realised that although the mast and keel are hinged longitudinally to the hull, the interconnection can be such that a required amount of reaction on the hull results with consequent effective control of the movement of the hull.

In a modification the keel itself could be fixed, but a balancing weight or weights can be moved to control the position of the boat in the water, or a combination of weights and movable vanes can be used to achieve the preferred relationship of the hull to the mast, the expression "keel" including such means when used to balance a hinged mast.

We claim:

1. A sailing vessel comprising:

a hull, a mast upstanding from said hull and connected thereto to be free to tilt on said hull about an axis arranged longitudinally of said hull, a keel depending from said hull and connected thereto to be free to tilt on said hull about an axis also arranged longitudinally on said hull, and means interconnecting said mast and said keel to cause rotation about said axes in the same sense, said interconnecting means being hydraulic and comprising a pair of oppositely acting actuators connected to said mast to displace hydraulic fluid in proportion to mast movement about said hull, lines from said actuators to a further hydraulic actuator which is connected to said keel, said further actuator receiving displaced fluid from said oppositely acting actuators to transmit mast movement to said keel about said hull, and means to by-pass fluid from one side to the other side of said further actuator to vary the relative angle of said keel to said mast, said keel having sufficient weight to hold said mast upright but allowing it to deflect leeward about said hull under wind pressure, said keel balancing said leeward deflection by tilt to windward, whereby the tilt of the mast is balanced by said keel and said hull does not necessarily deflect.

2. A sailing vessel according to claim 1 wherein the said second hydraulic motor is connected to said keel by a link which is variable in effective length to vary the angular relationship of keel to mast.

3. A sailing vessel according to claim 1 wherein the said second hydraulic motor is connected to said keel by a link which is variable in distance from the axis of the said keel whereby to vary the extent of movement of the said keel to the said mast.

* * * * *